US005123564A

United States Patent [19]

Hobson

[11] Patent Number: 5,123,564

[45] Date of Patent: Jun. 23, 1992

[54] COMPARTMENTED STORAGE CONTAINER

[75] Inventor: Jody A. Hobson, Rocky River, Ohio

[73] Assignee: Rubbermaid Incorporated, Wooster, Ohio

[21] Appl. No.: 819,054

[22] Filed: Jan. 10, 1992

[51] Int. Cl.[5] ..... B65D 21/02

[52] U.S. Cl. ..... 220/528; 220/23.83

[58] Field of Search ..... 220/527, 528, 23.83

[56] References Cited

U.S. PATENT DOCUMENTS

| | | | |
|---|---|---|---|
| 2,459,657 | 1/1949 | Klein | 220/528 X |
| 2,522,768 | 9/1950 | Wiepert | 220/528 X |
| 2,944,694 | 7/1960 | Kinsey | 220/23.83 X |
| 3,589,554 | 6/1971 | Smith | 220/23.83 |
| 4,024,590 | 5/1977 | Wendt | 220/23.83 X |

*Primary Examiner*—Steven M. Pollard
*Attorney, Agent, or Firm*—Richard B. O'Planick

[57] ABSTRACT

A compartmented storage container is disclosed comprising a container (2) having a bottom, parallel and spaced-apart endwalls (8) and sidewalls (6) extending from the bottom to an upper downturned rim flange (16). A chamber (12) is thereby defined. Opposing cutout recesses (18) are formed within opposite sidewalls (6) and a bar flange (24) extends upwardly from a bottom surface (22) of each recess (18). A tray is further provided having a downturned rim flange (44) along the top edge of endwalls, adapted to enter a container recess (18) and overlap the bar flange (24) therein. The tray, so positioned spans the sidewalls of the container and is suspended above the floor of the container chamber. The rim flange of the tray is dimensioned to be coplanar with corresponding surfaces of the container rim flange so as not to interfere with the application of a lid member (52) to the container. The sidewalls (32) of the tray (4) are further provided with cutout recesses (50) along an upper rim which accommodate the intermediate portion of the lid (53), used in the stacking of one such container on another.

15 Claims, 4 Drawing Sheets

COMPARTMENTED STORAGE CONTAINER

BACKGROUND OF THE INVENTION

1. Field of the Invention

The invention relates generally to plastic storage containers for general use in the storage of small items in a household, and specifically to such containers which have a tray incorporated therein for subcompartmentalization of such items.

2. The Prior Art

Plastic storage containers find broad use in a household environment. Such containers are used in the storage of small items, for example stationery, or for larger, bulkier items such as clothing. Conventional storage containers are molded of common plastic, for example high density polyethelene, and are configured to have a clear base and a solid top. The clear base enables the user to identify the contents of the container more readily. In addition, available containers have projections on the bottom of the base container which register within lid recesses of a second, like-configured container, whereby multiple containers may be stacked one upon another in order to conserve space.

One application for a plastic storage container is for the storing of gift wrapping. The user can keep rolls of gift wrapping within the container along with ancillary supplies such as tape, scissors, etc.

While the above, available containers are functionally and meet many needs of the consumer, there are several shortcomings attendant to their use. It is, at times, desirable to have a means for subdividing a container, particularly larger versions, into sub-compartments for segregated storage of articles. Conventional storage containers do not have the means for convienently facilitating this need. In addition, in the case where larger articles, such as wrapping paper, is stored with smaller items, it is desirable to have the container store the small items separately, in a position which is readily available to the user. All of the forgoing needs must be met without sacrificing the functional optimization of storage volume, and the stacking feature of the container described above.

SUMMARY OF THE PRESENT INVENTION

The present invention comprises a storage container of conventional external size, shape, and configuration. A lid is provided over a base container, and the lid has recess means which receive bottom projections of a like-configured second container, whereby the containers are stackable one upon another.

The base container comprises a bottom, parallel and spaced-apart endwalls and sidewalls which extend to an upper rim. A downturned peripheral rim flange extends about the upper rim. Positioned within each sidewall rim flange, proximate an endwall, is a stepped down recess slot defined by a bottom surface and recess endwalls. A bar flange projects upwardly from the recess bottom surface, with ends of the bar flange inset from the sidewalls of the recess, and an outermost side of the bar flange inset from an outermost edge of the recess bottom surface.

A tray is further provided, having a bottom and sidewalls and endwalls extending from the bottom to an upper edge. A downturned rim flange extends along the upper tray edge with the endwall portion of the rim flange projecting outward a sufficient distance to enter the container sidewall recess and overlap the bar flange thereof. So positioned, the tray is fixedly suspended proximate the top of the container, and spans the container sidewalls. The tray sidewall rim flange has an intermediate portion which is recessed below the tray endwall rim flange, whereby the lid recesses do not interfere with the tray sidewalls when positioned upon the container.

The fixed registration of the tray across the container provides the user with a secondary compartment in which to store small articles, yet leaves the entire length of the bottom surface of the container available to support long articles, such as wrapping paper rolls. If desired, the tray may be rotated ninety degrees and stored in the container, upon the bottom container surface.

The rim flange of the tray endwalls is of a depth such that, when positioned over the container recess bar flange, the top of the tray endwall rim flange is flush with the top of the container sidewall rim flange. The lid may then be attached to the container without interference from the tray. In addition, the stepped down sidewalls of the tray enable the lid recesses to function an intended, in the stacking of one container upon another, without interference from the tray.

Accordingly, it is an objective to provide a storage container having a compartment tray which can be utilized in storing items within the container.

A further objective is to provide a storage container which has a tray configured to span sidewalls of the container, above the bottom surface of the container.

Yet a further objective is to provide a storage container which is stackable, and which has an internal tray, suspended at the top, which does not interfere with the stacking function.

Another objective is to provide a storage container having an internal tray which is suspended from an upper rim of the container.

Still a further objective is to provide a compartmented storage container having an internal tray which can be received into the container in two optional manners.

A further objective is to provide a compartmented storage container having an internal tray which can be conveniently, and economically manufactured of conventional materials.

These, and other objectives, which will be apparant to those skilled in the art, are achieved by a preferred embodiment which is described below and which is illustrated by the accompanying drawings.

BRIEF DESCRIPTION OF ACCOMPANYING DRAWINGS

DESCRIPTION OF THE PREFERRED EMBODIMENT

Figure 1:
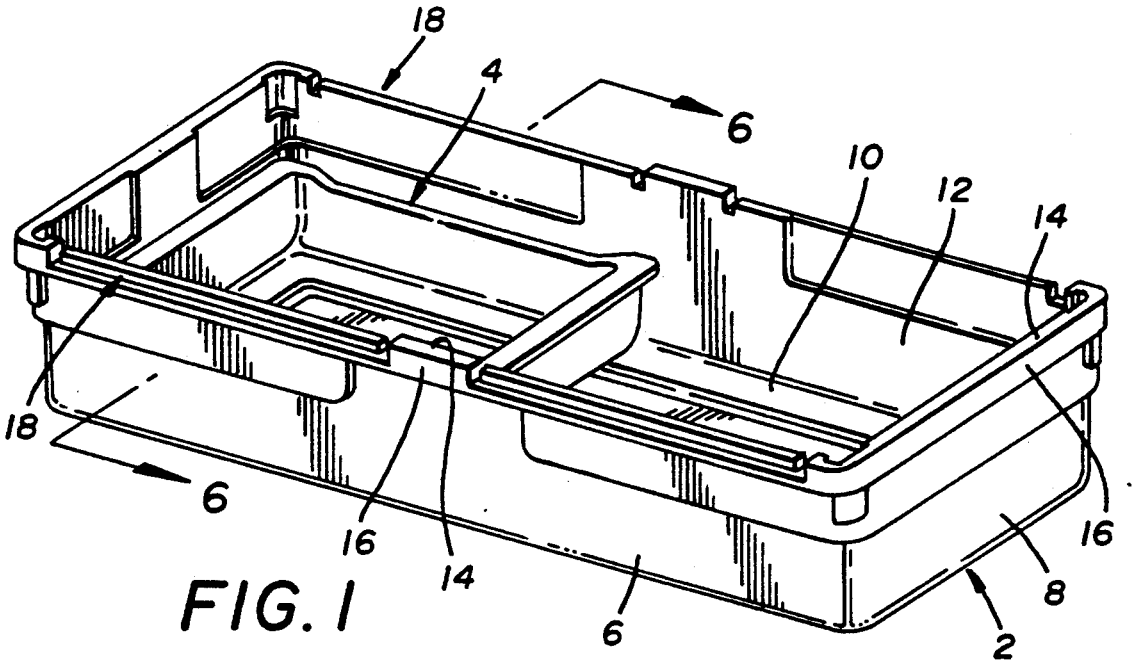
FIG. 1 is a perspective view of the subject container with the lid removed, and with the tray in its longitudinal storage position.
Figure 2:
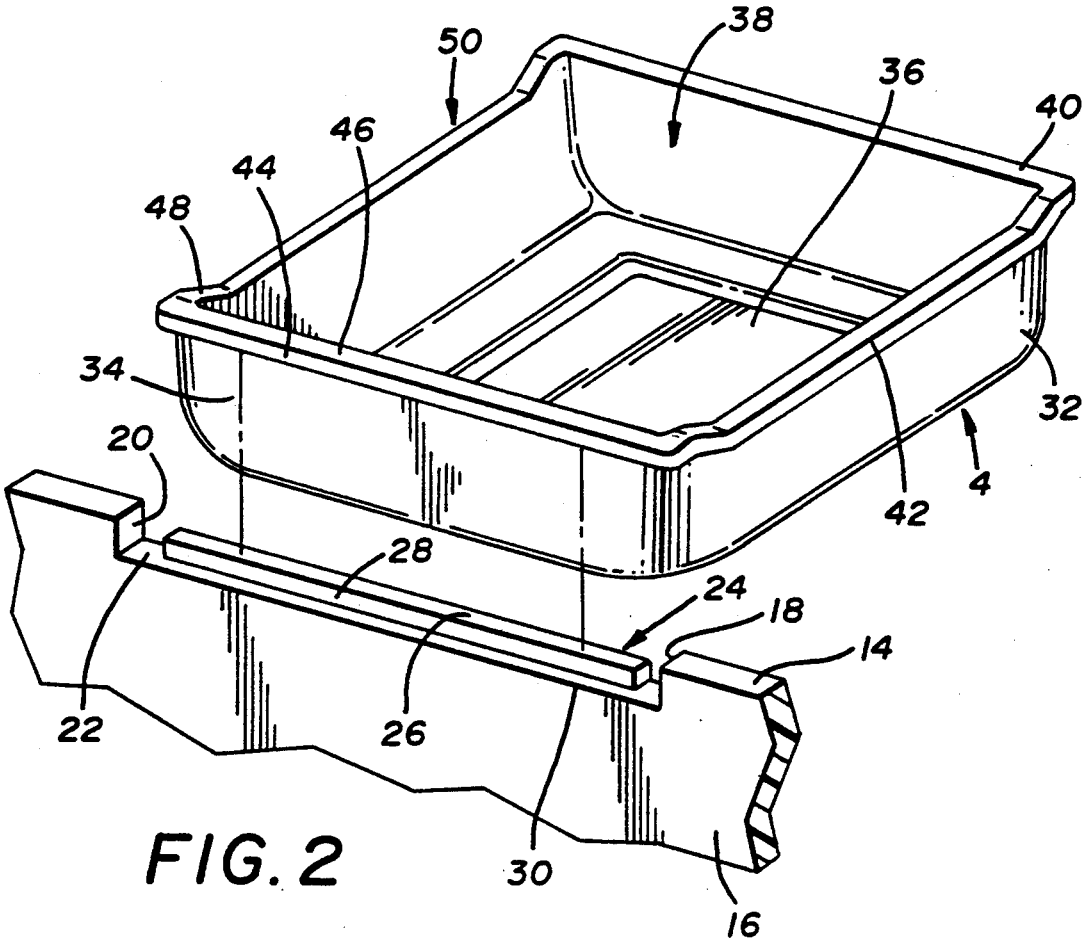
FIG. 2 is an enlarged perspective view of the tray and the portion of the container sidewall to which the tray overlaps.

Referring first to FIGS. 1 and 2, the subject embodiment comprises a four sided container 2 and a tray 4, each conventionally moldable from polyethylene or other suitable plastic material.

The container 2 has parallel longitudinal sidewalls 6 and endwalls 8, which, with an internal floor surface 10 define a rectangular chamber 12. The inward surfaces of sidewalls 6 and endwalls 8 extend upwardly from the floor 10 to an upper rim 14. A downturned rim flange 16 extends about the continuous periphery of the container, along the upper rim 14.

As shown, a stepped down recess, or cutout, 18 is provided within the upper rim flange of the container sidewalls 6, proximate the intersection with the endwalls. In the preferred embodiment, there are a total of four cutouts 18 provided, with one pair of sidewall recesses proximate one endwall and the other pair proximate the opposite endwall. More, or fewer, recesses may be placed in the container rim flange, at the preference of the manufacturer.

Each recess 18 is defined by opposed sidewalls 20 and a bottom surface 22. A rectangular bar flange 24 is provided to extend along, and project upwardly from, the recess bottom surface 22. As shown, ends of the bar flange 24 are inset a spacing from the recess sidewalls 20, and an outermost side 28 of the bar flange 24 is inset a spacing from the outer edge 30 of the recess 18. The purpose for the placement of bar flange 24 relative to the boundaries of recess 18 will be explained below.

The tray component 4 is generally rectangular, having elongate sidewalls 32 and endwalls 34, which with an internal floor 36, defining a central compartment 38. The sidewalls 32 and endwalls 34 extend from the floor 36 to an upper rim 40. A continuous rim flange extends along the upper rim 40, designated as sidewall rim flange 42 and endwall rim flange 44. It will be noticed that the endwall rim flange is wider than the sidewall rim flange 42 for a purpose explained below.

A top surface 46 of the tray rim flange steps downward along the sidewall 32, from the endwall 34, along a stepped transition region 48. A cutout or recess 50 is thereby formed in each tray sidewall, beginning proximate to one endwall 34 and continuing along the sidewall to a point proximate the other endwall 34.

Figure 3:
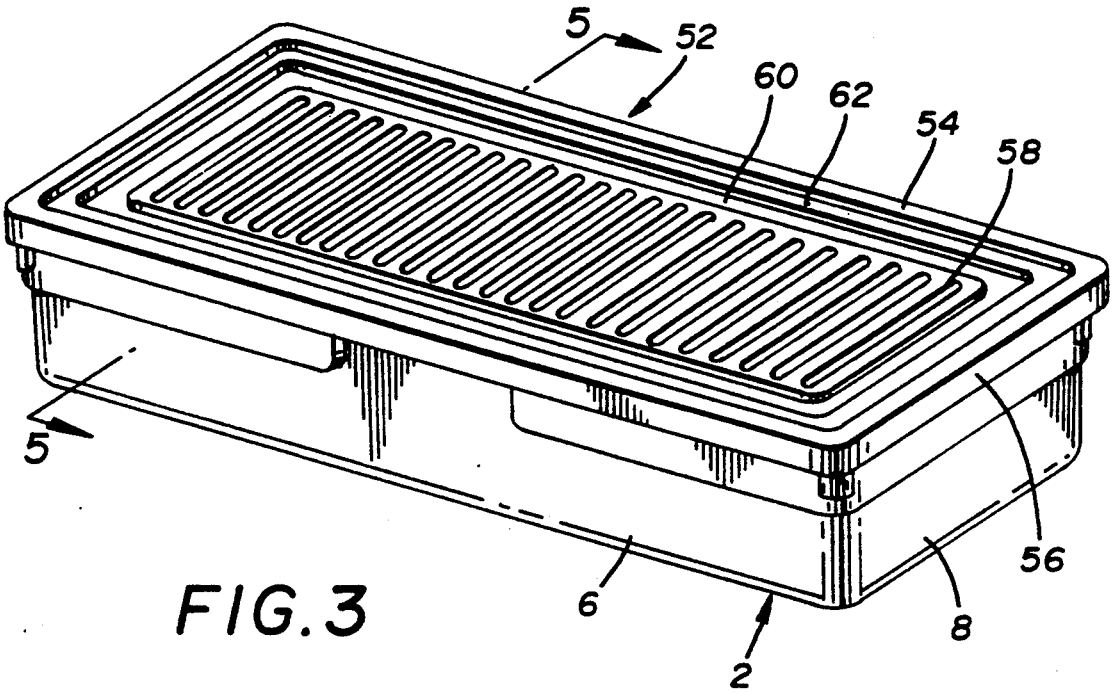
FIG. 3 is a perspective view of the subject container with the lid component mounted thereon.
Figure 5:
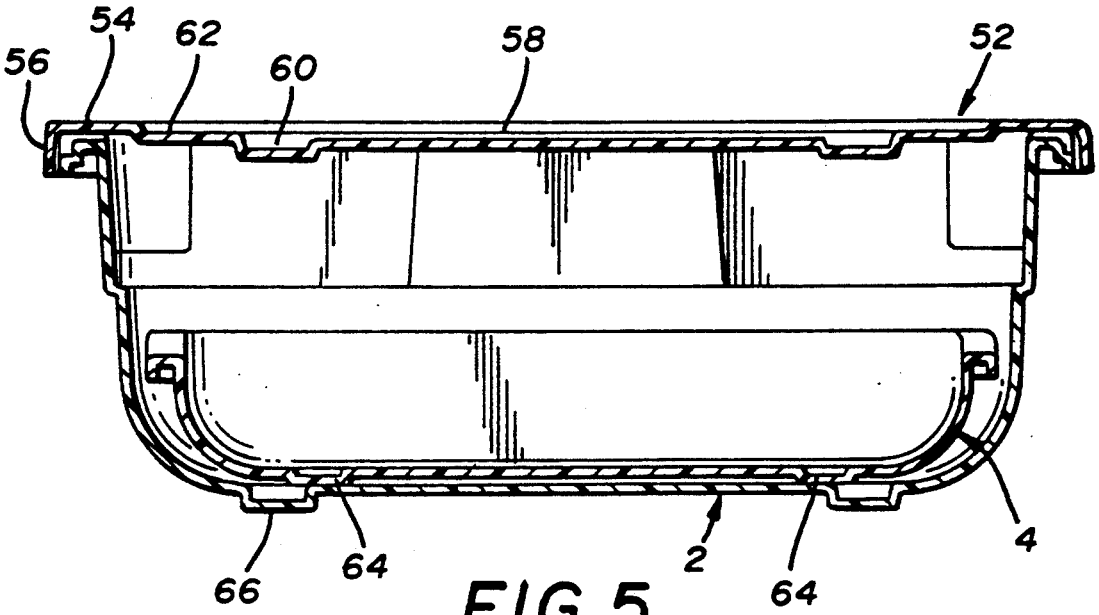
FIG. 5 is a transverse section view through the subject container taken along the line 5—5 of FIG. 3.

As best viewed from FIGS. 3 and 5, a lid 52 is provided for enclosing the container, comprising a top surface 54, and a peripheral downturned rim 56. The lid has formed in the top a central, raised plateau 58, surrounded by a channel 60, which, in turn, is surrounded by a vertically stepped border 62, which, then, is surrounded by the top surface 54. It will be noted that the tray member 4 is raised at the bottom by four feet 64, and that the container likewise is raised at the bottom by four feet 64.

FIG. 2 illustrates how the tray 4 is affixed to the container 2 so as to span the sidewalls 6. The tray endwall rim flange is dimensioned to closely enter the container sidewall recess 18 and overlap the bar flange 24. Ends of the bar flange 24 are inset from the outer sidewalls 20 of the recess 18, and the outer side 28 of bar flange 24 is inset from the outer edge 30 of the recess. Accordingly, upon overlapping the tray rim flange 44 over the bar flange 24, the top surface 46 of rim flange 44 is co-planar with the upper rim 14 of the container, and the dependent flange portion 44 is co-planar with the outer surface of the container rim flange 16. The tray rim flange 44 in essence fills the void of recess 18.

Figure 4:
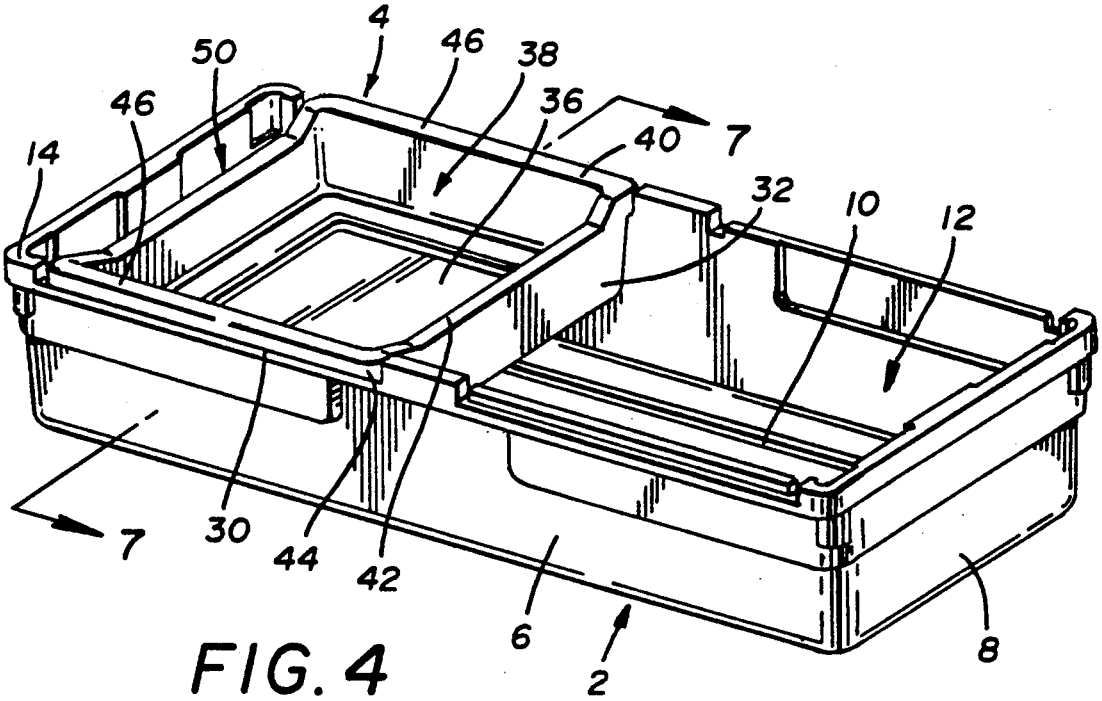
FIG. 4 is a perspective view of the subject container with the lid removed, and with the tray in its transverse, suspended position.

FIG. 4 illustrates the tray in its transverse position, with opposite endwalls of the tray overlapping upper edges of the container sides. It will be noted that the tray rim flange upper surface 46 and outer portion 44 do not project out beyond the container rim flange. It will further be noted that the tray is suspended above the floor 10 of the container chamber 12, such that long articles, for example wrapping paper, may be stored in the bottom of the container, and smaller articles, for example scissors, tape, etc. may be stored in the tray.

The container shows a second set of recesses in FIG. 4, for a second tray, if so desired by the user.

Figure 6:
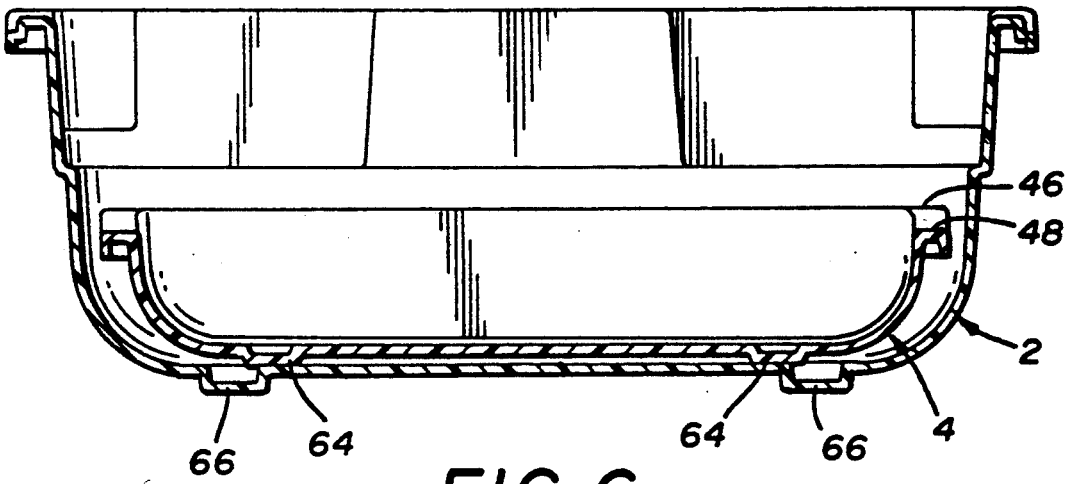
FIG. 6 is a transverse section view through the subject container and tray taken along the line 6—6 of FIG. 1.

As depicted in FIGS. 1, 5, and 6, the tray can be rotated ninety degrees and stored on the bottom of the container if so desired.

Figure 7:
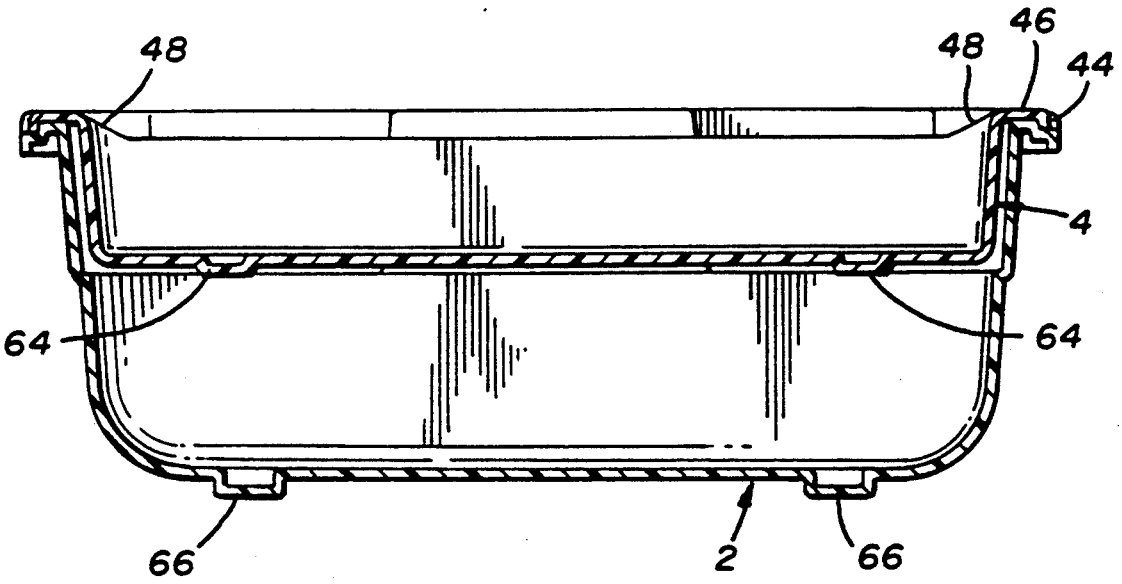
FIG. 7 is a transverse section view of through the subject container and tray, taken along the line 7—7 of FIG. 4.

FIGS. 3 and 5 show the container lid in place. The lid rim 56 fits over the rim flange of the container, and inward projections (not shown) from the flange 56 engage under the rim flange 16 of the container to lock the lid in place, in conventional fashion. The feet 66 of the container are dimensioned and positioned to enter channel 60 of a second container, thus registering the containers into a vertical stack. It will be appreciated from FIGS. 2 and 7 that the tray sidewalls 32 do not interfere with any portion of the recessed lid portions, including channel 60, because the sidewalls 32 contain cutout recesses 50 along their upper rim. Accordingly, the tray(s) in the suspended transverse orientation will not interfere with the application of the lid to the container.

While the above describes the preferred embodiment, the teachings herein set forth are not to be so restricted. Other embodiments, which utilized such teachings, are intended to be within the scope and spirit of the present invention.

I claim:

1. A compartmented storage container having a bottom, parallel and spaced-apart endwalls and sidewalls extending from said bottom to an upper rim, an upwardly open interior chamber defined by said bottom, endwalls, and sidewalls, and a lid positionable over said upper rim for enclosing said chamber;

said container further comprising at least one elongate stepped recess in opposite sidewall rims, said recess being defined by a bottom surface and opposed recess sidewalls, and said recess further comprising an upraised bar flange extending along said recess bottom surface, said bar flange having an outer side positioned inwardly from an outer edge surface portion of said recess bottom surface, and said bar flange having ends inset from opposing said recess sidewalls;

said container having a compartment tray, said tray having a bottom, spaced-apart and parallel endwalls and sidewalls extending from said bottom to an upper rim, and a downturned rim flange extending along said upper rim of said endwalls, said container sidewalls having a length dimension to span said container between said container sidewalls, and said tray endwalls having a length dimension to span said recess bottom surface; and said downturned tray endwall rim flange being positioned to register within said recess and overlap said recess bar flange with said tray oriented to span said container sidewalls.

2. A storage container according to claim 1, wherein said upper container rim and said downturned rim flange along said container sidewalls having a downwardly stepped intermediate segment and upraised end segments.

3. A storage container according to claim 2, wherein said tray endwall upper rim extending along a respective container sidewall recess in co-planar orientation with said container upper rim.

4. A storage container according to claim 3, wherein said tray endwall upper rim flange having a width substantially equal to the width of said container sidewall recess.

5. A storage container according to claim 4, wherein said lid having centrally disposed depression means, and said container bottom having centrally disposed, complementary, projection means adapted to register within a second container lid depression means in stacking fashion.

6. A storage container according to claim 5, wherein said tray upon rotation about a central vertical axis ninety degrees, is dimensioned to fit upon a bottom floor of said container chamber between said container sidewalls.

7. A storage container according to claim 6, wherein said bar flange having an upper surface recessed below said container upper rim.

8. A compartmented storage container having a bottom, parallel and spaced-apart endwalls and sidewalls extending from said bottom to an upper rim, an upwardly open interior chamber defined by said bottom, endwalls, and sidewalls, and a lid positionable over said upper rim for enclosing said chamber;

said chamber further comprising at least one elongate stepped recess in opposite sidewall rims, said recess being defined by a bottom surface and opposed recess sidewalls, and said recess further comprising an upraised bar flange extending along said recess bottom surface;

said container having a compartment tray, said tray having a bottom, spaced-apart and parallel endwalls and sidewalls extending from said bottom to an upper rim, and a downturned rim flange extending along said upper rim of said endwalls and said sidewalls, said container sidewalls having a length dimension to span said container between said container sidewalls, and said tray endwalls having a length dimension to span said recess bottom surface;

said downturned tray endwall rim flange registering within said sidewall recess and overlapping said recess bar flange with said tray oriented to span said container sidewalls;

said sidewall rim flange having a central portion extending below and parallel to said endwall rim flange, and said sidewall rim flange having inclined end portions extending from said central portion to intersect with opposite said endwall rim flanges.

9. A container according to claim 8, wherein said lid having centrally disposed registration means adapted to engage complementary registration means in the bottom of a like-configured second container, whereby said containers stacking upon one another.

10. A container according to claim 9, wherein said lid registration means comprising a recessed channel and said container bottom registration means comprising support feet positioned and dimensioned to fit within said channel of said second container.

11. A container according to claim 8, wherein said bar flange having an outer side positioned inwardly from an outer edge surface portion of said container sidewall recess bottom surface, and said bar flange having ends inset from opposing said recess sidewalls a predetermined space, with portions of said tray sidewall rim flange registering within a said space.

12. A container according to claim 11, wherein said tray endwall upper rim extending along a respective container sidewall recess in co-planar relationship with said container upper rim.

13. A container according to claim 12, wherein said tray endwall upper rim flange having a width substantially equal to the width of said container sidewall recess.

14. A container according to claim 13, wherein said tray, upon rotation about a central vertical axis ninety degrees, is dimensioned to fit upon a bottom floor of said container chamber between said container sidewalls.

15. A container according to claim 14, wherein said bar flange having an upper surface recessed below said container upper rim.

* * * * *